US008497824B2

(12) United States Patent
Jeong

(10) Patent No.: US 8,497,824 B2
(45) Date of Patent: Jul. 30, 2013

(54) PIXEL AND ORGANIC LIGHT EMITTING DISPLAY DEVICE USING THE SAME

(75) Inventor: Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 204 days.

(21) Appl. No.: 12/980,043

(22) Filed: Dec. 28, 2010

(65) Prior Publication Data

US 2012/0019498 A1 Jan. 26, 2012

(30) Foreign Application Priority Data

Jul. 22, 2010 (KR) ..... 10-2010-0070948

(51) Int. Cl.
*G09G 3/30* (2006.01)

(52) U.S. Cl.
USPC ..... 345/76; 345/92

(58) Field of Classification Search
None
See application file for complete search history.

(56) References Cited

U.S. PATENT DOCUMENTS

| | | | | |
|---|---|---|---|---|
| 2004/0090434 | A1* | 5/2004 | Miyazawa | 345/204 |
| 2007/0052635 | A1* | 3/2007 | Kimura | 345/76 |
| 2007/0234152 | A1* | 10/2007 | Kwon et al. | 714/726 |
| 2008/0284929 | A1* | 11/2008 | Kimura | 349/38 |
| 2008/0291182 | A1* | 11/2008 | Yamashita et al. | 345/204 |
| 2009/0251452 | A1* | 10/2009 | Kang et al. | 345/211 |
| 2009/0284515 | A1* | 11/2009 | Tsuge | 345/211 |
| 2010/0079430 | A1* | 4/2010 | Yamashita et al. | 345/210 |

FOREIGN PATENT DOCUMENTS

| | | |
|---|---|---|
| KR | 10-2009-0016333 | 2/2009 |
| KR | 10-0893481 | 4/2009 |
| KR | 10-0903496 | 6/2009 |
| KR | 1020090131041 | * 10/2009 |
| KR | 10-2009-0123562 | 12/2009 |
| KR | 10-0936883 | 1/2010 |

OTHER PUBLICATIONS

KR1020090131041—Machine translation.*
English-language abstract of Korean Publication No. 10-2008-0067489.
English-language abstract of Korean Publication No. 10-2009-0131041.

* cited by examiner

*Primary Examiner* — Amare Mengistu
*Assistant Examiner* — Antonio Xavier
(74) *Attorney, Agent, or Firm* — Christie, Parker & Hale, LLP

(57) ABSTRACT

A pixel which allows compensating a threshold voltage of a driving transistor and a mobility deviation is provided. The pixel includes an organic light emitting diode connected between a first power supply and a second power supply, a first transistor connected between the first power supply and the organic light emitting diode, wherein the gate electrode of the first transistor is connected to a first node, a second transistor connected between the first node and the data line, wherein the gate electrode of the second transistor is connected to the scanning line, a third transistor connected between an access node of the first transistor and the organic light emitting diode, and the second power supply, that is turned on during the scanning period which the second transistor is turned on; and, first and second capacitors connected between the first power supply and the first node, wherein an access node of the first and second capacitor is connected to an access node of the first and third transistor.

13 Claims, 6 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Application No. 10-2010-0070948, filed Jul. 22, 2010, in the Korean Intellectual Property Office, the disclosure of which is incorporated herein by reference.

BACKGROUND

1. Field

An aspect of the present invention relates to a pixel and an organic light emitting display device using the same, and more particularly, to an organic light emitting display device using a pixel that compensates a threshold voltage of a driving transistor and mobility deviation.

2. Description of the Related Art

Recently, all sorts of flat panel display devices are being developed, due to their superior characteristics as compared to the traditional cathode ray tube. For example, flat panel display devices have a lighter weight and a smaller volume or thickness than a cathode ray tube.

Especially, an organic light emitting display (OLED) device among the flat panel display devices is being considered as the next generation display device because of its excellent luminance and color purity. This is due to the OLEDs ability to display an image using an organic light emitting diode which is a self-emitting device.

The above-mentioned organic light emitting display device may be divided into a passive matrix organic light emitting display device (PMOLED) and an active matrix organic light emitting display device (AMOLED) according to the driving of the organic light emitting diode.

The active matrix organic light emitting display device includes a plurality of pixels arranged at the intersection between scanning lines and data lines. In addition, each pixel includes the organic light emitting diode and a pixel circuit for driving the organic light emitting diode. The pixel circuit is typically composed of a switching transistor, a driving transistor, and a storage capacitor.

The active matrix organic light emitting display device may be useful in a portable display device, and the like, because of its low electric power consumption.

However, the active matrix organic light emitting display device has the disadvantage that the definition is decreased due to a threshold voltage of the driving transistor and the mobility deviation of each pixel.

SUMMARY

An aspect of the present invention provides a pixel and an organic light emitting display device using the same that compensates the threshold voltage of the driving transistor and the mobility deviation while having a simple structure.

According to one aspect of the present invention, there is provided a pixel including an organic light emitting diode connected between a first power supply and a second power supply; a first transistor connected between the first power supply and the organic light emitting diode, in which a gate electrode of the first transistor is connected to a first node; a second transistor connected between a first node and a data line, in which the gate electrode of the second transistor is connected to a scanning line; a third transistor connected between the first power supply and the first transistor, in which the gate electrode of the third transistor is connected to the light emitting control line; a fourth transistor connected between an access node of the first transistor and the organic light emitting diode and the second power supply, in which the second transistor is turned on during the scanning period in which the second transistor is turned on; first and second capacitors connected between the first power supply and the first node, in which the access node of the first and second capacitors provide a pixel connected to the access node of the first and third transistors.

According to another aspect of the present invention, the third transistor and the fourth transistor are turned on together by the second transistor during the first period that is the initial period among the scanning period, and the first voltage (Vsus) may be supplied to the data line during the first period.

According to another aspect of the present invention, the third transistor is turned off from the second period that follows the first period among the scanning period to keep the turn off condition during the rest of the scanning period and to be turned on after the scanning period is completed.

According to another aspect of the present invention, the gate electrode of the fourth transistor may be connected to the scanning line.

According to another aspect of the present invention, during the first period and following the second period of the scanning period, the first voltage is supplied from the data line, and during the third period that follows the first and second period, a data signal (Vdata) may be provided to the data line.

According to another aspect of the present invention, the gate electrode of the fourth transistor is connected to the control line; the fourth transistor is turned on during the first and second period and is turned off during the third period corresponding to the control signal that is provided from the control line.

According to another aspect of the present invention, the pixel is connected between the access node of the first and fourth transistors and the organic light emitting diode, and may further include the fifth transistor that the gate electrode is connected to the light emitting control line.

According to another aspect of the present invention, the first voltage may be set less than the voltage of the first power supply by more than the threshold voltage of the first transistor.

According to another aspect of the present invention, the first power supply may be set up by the high potential pixel power supply, and the second power supply may be set up by the low potential pixel power supply.

According to another aspect of the present invention, there is provided an organic light emitting display device including an organic light emitting diode having a scanning driver that sequentially supplies the scanning signal to the scanning lines, and supplies the light emitting control signal to the light emitting control lines that are aligned with the scanning lines, a data driver that supplies the data signal to the data lines, and the pixel unit that is arranged in the intersection of the scanning lines, the light emitting control lines and the data lines, and includes a plurality of pixels supplied with the first power supply and the second power supply, wherein each of the plurality of pixels is connected between the first power supply and the second power supply; the first transistor is connected between the first power supply and the organic light emitting diode, wherein the gate electrode of the first transistor is connected to the first node; the second transistor is connected between the first node and the data line, wherein the gate electrode of the second transistor is connected to the scanning line; the third transistor is connected between the first power supply and the first transistor, wherein the gate electrode of the third transistor is connected to the light emitting control line; the fourth transistor is connected between the access node of the first transistor and the organic light emitting diode and the second power supply, and is turned on during the scanning period that the second transistor is turned on; the first and second capacitors between the first power supply and the first node; wherein the access node of the first and the second capacitor is connected to the access node of the first and third transistors.

According to another aspect of the present invention, the scanning driver supplies the light emitting control signal to turn on the third transistor to the light emitting control line connected to the pixel during the first period that is initial period among the scanning period of each pixel that the scanning signal is supplied to the scanning line, and may supply the light emitting control signal to turn off the third transistor to the light emitting control line during the rest of the scanning period.

According to another aspect of the present invention, the data driver supplies the first voltage (Vsus) to the data line during the first period and the following second period among the scanning period, and may supply the data signal (Vdata) to the data line during the third period following the first and second period among the scanning period.

According to another aspect of the present invention, the organic light emitting display device further includes the control lines connected to the gate electrode of the fourth transistor equipped with the pixels, and that are aligned with the scanning lines, and the control line driver that sequentially supplies the control signal to the control lines.

According to another aspect of the present invention, the control line driver may supply the control signal to run on the fourth transistor to the control line connected to the pixel during the first and second period that the first voltage is supplied to the data line during the scanning period of each pixel that the scanning signal is supplied to the scanning line, and may supply the control signal to turn off the fourth transistor to the control line during the third period that the data signal is supplied to the data line during the scanning period.

According to another aspect of the present invention, each pixel is connected between the access node of the first and fourth transistor and the organic light emitting diode, and further includes the fifth transistor having the gate electrode connected to the light emitting line.

According to another aspect of the present invention, a plurality of pixels located in the same column line among the pixels may be formed to share the second capacitor. Here, a plurality of pixels located in the same column line among the pixels may be formed to share the third transistor.

According to another aspect of the present invention, the organic light emitting display device further includes the switch unit having the first switches connected between the first input line that the data signal is inputted from the data driver, and the data lines; the second switches connected between the second input line that the constant first voltage is inputted, and the data lines, and is alternately turned on with the first switches.

According to another aspect of the present invention, a uniform defined image could be displayed by compensating the threshold voltage of the driving transistor and the mobility deviation while forming pixels having relatively simple structure.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
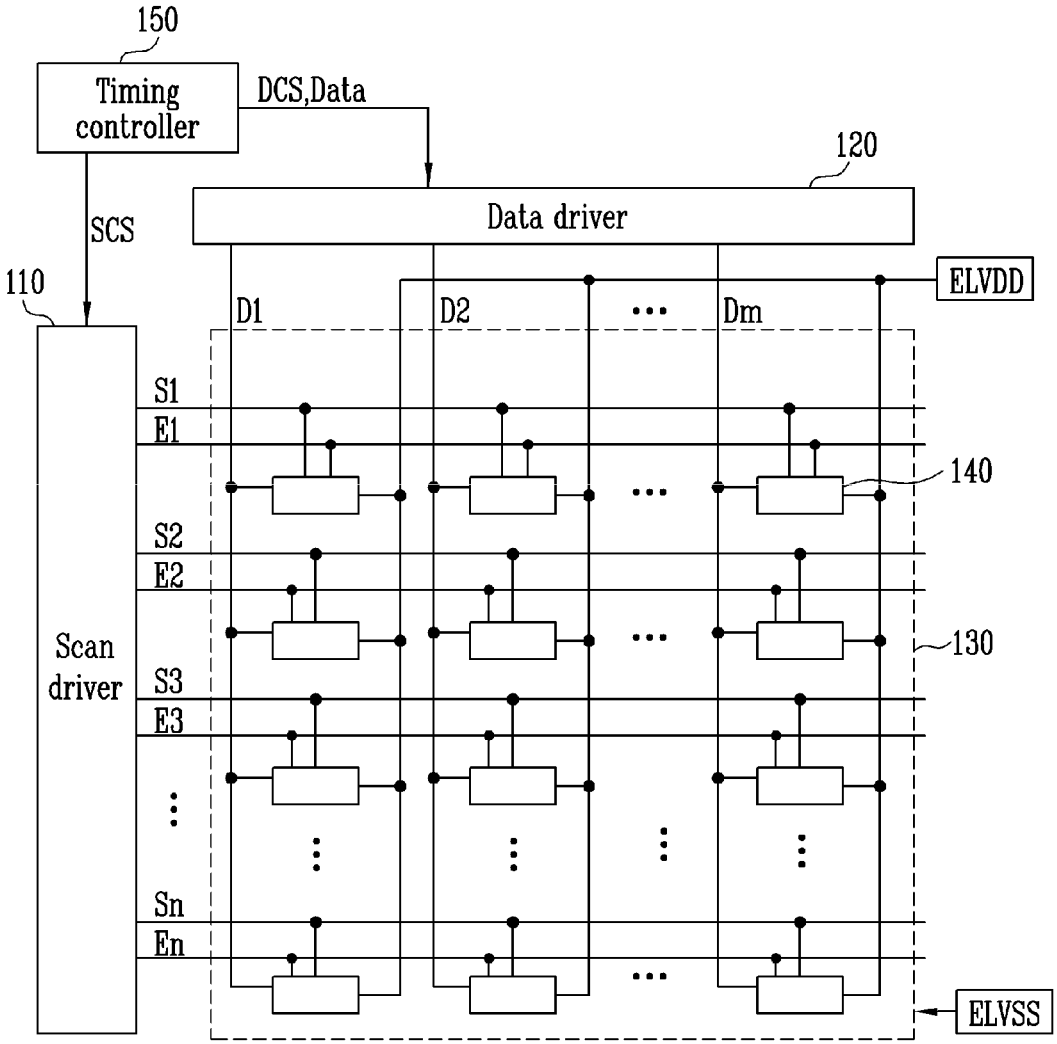
FIG. 1 is a block view showing a structure of an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout. Hereinafter, the embodiments of the present invention will be descried in more detail with reference to the accompanying drawings.

FIG. 1 is a block view roughly showing a structure of an organic light emitting display device according to an embodiment of the present invention. Referring to FIG. 1, an organic light emitting display device according to an embodiment of the present invention includes a pixel unit 130 including a plurality of pixels arranged in the intersection of scanning lines S1 to Sn, light emitting control lines E1 to En and data lines D1 to Dm, a scanning driver 110 for driving the scanning lines S1 to Sn and the light emitting control lines E1 to En, a data driver 120 for driving the data lines D1 to Dm, and a timing controller 150 for controlling the scanning driver 110 and the data driver 120.

The scanning driver 110 is supplied with a scanning driving control signal (SCS) from the timing controller 150. The scanning driver 110 supplied with the scanning driving control signal (SCS) produces a scanning signal, and then sequentially supplies the produced scanning signal to the scanning lines S1 to Sn.

In addition, the scanning driver 110 supplies the light emitting control signal to the light emitting control lines E1 to En that are aligned with the scanning lines S1 to Sn, corresponding to the scanning driving control signal (SCS).

However, the scanning driver 110 supplies the light emitting control signal to the light emitting control line E, in which the fixed transistors in the pixels may be turned on during the initial period (first period) among the scanning period in which the scanning signal is supplied on the basis of the pixels 140 supplied with the scanning signal. The scanning driver 110 also supplies the light emitting control signal to turn off the fixed transistor to the light emitting control line E during the rest of the scanning period.

Meanwhile, for convenience, FIG. 1 shows that one scanning driver 110 produces and outputs all the scanning and light emitting control signals, but the aspects of the present invention are not limited thereto.

In other words, a plurality of the scanning drivers 110 may supply the scanning signal and the light emitting control signal from both sides of the pixel unit 130, or a driving circuit that produces and outputs the light emitting control signal and a driving circuit that produces and outputs the scanning signal may be separated as distinct driving circuits. In such embodiment, the circuit that produces and outputs the scanning signal may be called the scanning driver and the circuit that produces and output the light emitting control signal may be called the light emitting control driver. In this configuration, the scanning driver and the light emitting control driver may be formed on the same side of the pixel unit 130, or may be formed on different sides of the pixel unit 130 and face each other.

The data driver 120 is supplied with a data driving control signal (DCS) from the timing controller 150. The data driver 120 supplied with the data driving control signal (DCS) produces a data signal (Vdata) corresponding to the DCS, and then supplies the produced data signal to the data lines D1 to Dm.

However, the data driver 120 supplies the first voltage (Vsus) to the data line D1 to Dm, during the first period among the scanning period of the pixel. That is the data driver 120 supplies the Vsus during the initial period the light emitting control signal is supplied such that the fixed transistors in the pixels may be turned on, and during the second period which is followed by the first period among the scanning period, and the part of the rest period which the light emitting control signal is supplied such that the fixed transistors in the pixels may be turned off. Here, the first voltage (Vsus) may be set to a lower voltage than the first power supply (ELVDD) by more than the threshold voltage of the driving transistor in the pixel.

Then, the data driver 120 allows the data signal (Vdata) to be stored in the pixels by supplying the data signal (Vdata) to the data lines D1 to Dm during the third period followed the second period of the scanning period.

In other words, the data driver 120 may alternately supply the first voltage (Vsus) and the data signal (Vdata) to the data lines D1 to Dm, corresponding to the supplying time of the scanning signal and light emitting control signal.

The timing controller 150 produces the data driving control signal (DCS) and the scanning driving control signal (SCS), corresponding to synchronizing signals supplied from the outside. The data driving control signal produced in the timing controller 150 is supplied to the data driver 120, and the scanning driving control signal (SCS) is supplied to the scanning driver 110. In addition, the timing controller 150 supplies the data supplied from the outside to the data driver 120.

The pixel unit 130 is supplied with a first power supply (ELVDD) as a high potential pixel power supply and a second power supply (ELVSS) as a low potential pixel power supply from the outside and then supplies to each pixel 140, respectively. Each pixel 140 supplied with the first power supply (ELVDD) and the second power supply (ELVSS) produces light corresponding to the data signals.

Figure 2:
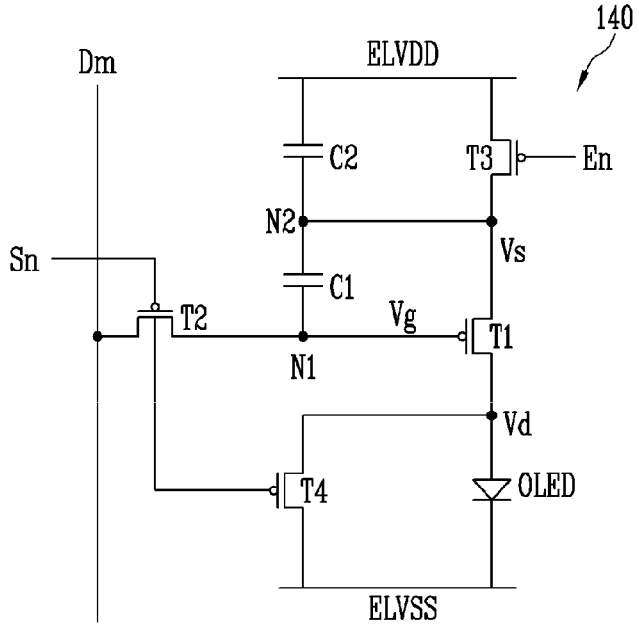
FIG. 2 is a circuit view showing pixels of an organic light emitting display device according to another embodiment of the present invention.

FIG. 2 is a circuit diagram showing pixels of an organic light emitting display device according to an embodiment of the present invention. For convenience, FIG. 2 shows that the pixel is arranged at the n-th (here, n is a natural number) horizontal line and connected to the m-th data line Dm.

Referring to FIG. 2, the pixel 140 of the organic light emitting display device includes the organic light emitting diode (OLED) connected between the first power supply (ELVDD) and the second power supply (ELVSS), a first transistor T1 connected between the first power supply (ELVDD) and the organic light emitting diode (OLED), a second transistor T2 connected between the data line Dm and a gate electrode of the first transistor T1, a third transistor T3 connected between the first power supply (ELVDD) and the first transistor T1, a fourth transistor T4 connected between the access node of the first transistor T1 and the organic light emitting diode (OLED) and the second power supply (ELVSS), the first and second capacitor C1, C2 connected between the first power supply (ELVDD) and the gate electrode of the first transistor T1, and the access node of the first and second capacitor C1, C2 is connected to the access node of the first and third transistor T1, T3.

More specifically, the first electrode of the first transistor T1 is connected to the first power supply (ELVDD) via the third transistor T3, and the second electrode of the first transistor T1 is connected to the organic light emitting diode (OLED). In this configuration, the first electrode and the second electrode of the first transistor T1 are different electrodes, and for example, when the first electrode is a source electrode, the second electrode is a drain electrode. In addition, the gate electrode of the first transistor T1 is connected to the first node N1.

The first transistor T1 controls a driving current that is supplied to the organic light emitting diode (OLED), corresponding to voltage of the first node N1, and functions as a driving transistor of pixels 140.

The first electrode of the second transistor T2 is connected to the data line Dm, and the second electrode is connected to the first node N1 to which the gate electrode of the first transistor T1 is connected. In addition, the gate electrode of the second transistor T2 is connected to the scanning line Sn.

The second transistor T2 is turned on during the scanning period to which the scanning signal is supplied from the scanning line Sn to the gate of the second transistor T2, and then the second transistor T2 delivers the data signal (Vdata) supplied from the data line Dm to the inside of the pixels 140.

The first electrode of the third transistor T3 is connected to the first power supply (ELVDD), the second electrode is connected to the second node N2 to which the first electrode of the first transistor T1 is connected. In addition, the gate electrode of the third transistor T3 is connected to the light emitting control line En.

The third transistor T3 controls the connection between the first power supply (ELVDD) and the second node N2 corresponding to the light emitting control signal supplied from the light emitting control line En.

The first electrode of the fourth transistor T4 is connected to the second electrode of the first transistor T1, the second electrode of the fourth transistor T4 is connected to the second power supply (ELVSS). In other words, the fourth transistor T4 is connected to the organic light emitting diode (OLED) in parallel.

The fourth transistor T4 turns on during the scanning period, in which the second transistor T2 is turned on, and applies the second power supply (ELVSS) to the second electrode of the first transistor T1. For these, the gate electrode of the fourth transistor T4 may be connected to the scanning line Sn.

The pixel 140 is driven such that the threshold voltage of the first transistor T1 and the mobility deviation and the voltage drop of the first power supply (ELVDD) are compensated. Accordingly, the pixel 140 may be used in a large size panel, and the organic light emitting display device equipped with the same may display a uniform definition image.

In particular, the pixel 140 may be used to design a high-resolution panel because of its simple structure in which the number of transistors and input signals are relatively small.

The description for the operation process of the pixel 140 will be described as follows referring to FIG. 3.

Figure 3:
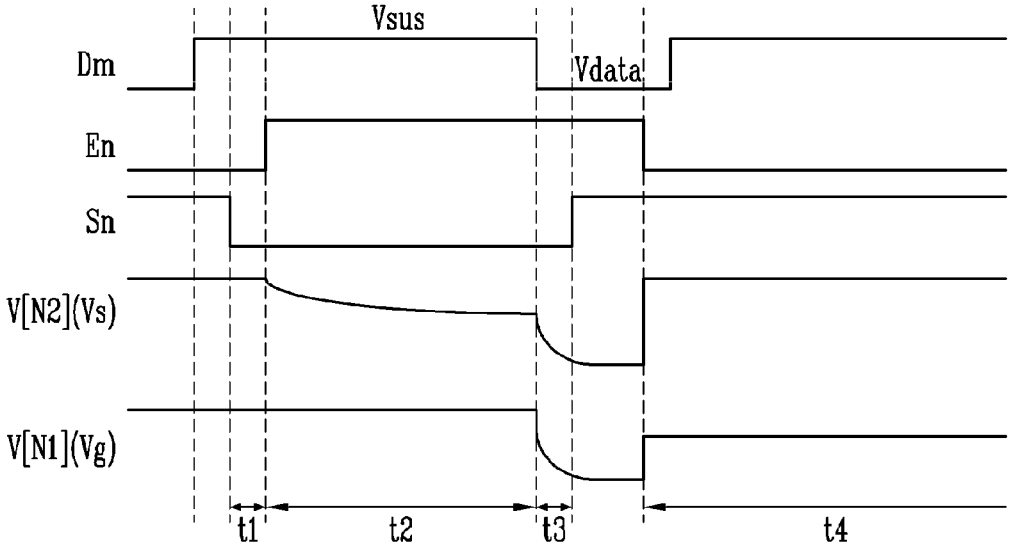
FIG. 3 is a waveform view showing a method of driving pixels as depicted in FIG. 2.

FIG. 3 is a waveform view showing the method for driving pixels as depicted in FIG. 2. Referring to FIG. 3, the light emitting control signal supplied from the light emitting control line En is kept at a voltage at which the third transistor T3 may be turned on (e.g., low voltage) during the first period t1. That is, the initial period among the scanning period t1~t3 in which the scanning signal is supplied from the scanning line Sn. In addition, the light emitting control signal is switched to the voltage at which the third transistor T3 is able to turn off (e.g., high voltage) during the rest period t2, t3 following the first period t1 during the scanning period. The above-mentioned light emitting control signal is switched to the voltage at which the third transistor T3 is capable of turning on again during the light emitting period t4 which occurs after the scanning period t1~t3 is completed.

On the other hand, the first voltage (Vsus) and the data signal (Vdata) are alternately supplied from the data line Dm. In particular, the first voltage (Vsus) is supplied from the data line Dm during the first period t1 in which the scanning signal and the light emitting control signal are all set to a low voltage during the scanning period t1~t3, and the second period t2 that is part of the period of the rest followed by the first period t1 among the scanning period. The data signal (Vdata) is supplied from the data line Dm during the third period t3 followed by the first and second period t1, t2 among the scanning period.

Accordingly, the threshold voltage of the first transistor T1 is stored during the second period t2, the data signal (Vdata) is stored during the third period t3, as well as the voltage that makes it possible to compensate for the mobility of the first transistor T1, thus the pixel 140 uniformly emits light by the luminance corresponding to the data signal (Vdata) regardless of the threshold voltage of the first transistor T1 and the mobility deviation during the following fourth period t4.

The method for driving the pixel 140 shown in FIG. 2 is illustrated in FIG. 3. As illustrated in FIG. 3, if the scanning signal and the light emitting control signal of the low voltage are supplied during the first period t1, that is the initial period of the scanning period, the second, third and fourth transistor T2, T3, T4 are turned on. In addition, the first voltage (Vsus) that is lower than the voltage of the first power supply (ELVDD) by more than the threshold voltage of the first transistor T1 from the data line Dm during the first period t1, is supplied. At this time, by initiating the supply of the first voltage (Vsus) to the data line Dm before the scanning period t1~t3, the first voltage (Vsus) may be supplied stably.

If the second transistor T2 is turned on, the first voltage (Vsus) is delivered to the first node, then the gate voltage Vg (the voltage of the first node (V[N1])) of the first transistor T1 becomes the first voltage (Vsus).

If the third transistor T3 is turned on, the voltage of the first power supply (ELVDD) is delivered to the second node N2, then the source voltage Vs (the voltage of the second node (V[N2])) of the first transistor T1 becomes the voltage of the first power supply (ELVDD).

If the fourth transistor T4 is turned on, the voltage of the second power supply (ELVSS) is delivered to the second electrode of the first transistor T1, that is the drain electrode. Thereafter, the drain voltage (Vd) of the first transistor T1 becomes the voltage of the second power supply (ELVSS).

In other words, the first transistor T1 is initialized while the first voltage (Vsus), the voltage of the first power supply (ELVDD) and the voltage of the second power supply (ELVSS) are delivered to the gate electrode, the source electrode and the drain electrode of the first transistor T1 during the first period t1.

The first voltage (Vsus) is set to a voltage lower than the first power supply (ELVDD) which is higher than the threshold voltage of the first transistor T1, thus the first transistor T1 is turned on. However, the first voltage (Vsus) is set to a lower voltage compared to the voltage of the first power supply (ELVDD), and to the high voltage compared to the data signal for displaying the high gradation, for instance the first transistor T1 may be weakly turned on by being set the voltage between the black data signal for displaying black and the white data signal for displaying white.

Subsequently, if the light emitting control signal of high voltage is supplied during the second period t2 following the first period t1, the third transistor T3 is turned off. And then, the source electrode of the first transistor T1 is kept in a floating state.

In addition, the second and fourth transistor T2, T4 are kept on the turn-on condition by the scanning signal of low voltage, and then the gate voltage Vg and the drain voltage Vd of the first transistor T1 are the first voltage (Vsus) and the voltage of the second power supply (ELVSS), respectively.

During the above-mentioned second period t2, the turn-on condition changes to the turned off condition when the voltage between the gate and the source is equal to the threshold voltage of the first transistor T1 while the voltage of the source electrode drops when the first transistor T1 is kept in the floating state (source voltage Vs). At this time, the threshold voltage of the first transistor t1 is stored in the first capacitor C1.

In other words, the second period t2 is set to the threshold voltage store period that the threshold voltage of the first transistor T1 is stored in the pixel (especially, the first capacitor C1).

Subsequently, the data signal (Vdata) is supplied to the data line Dm during the third period t3 following the second period t2 among the scanning periods.

Accordingly, the voltage of the first node (V[N1]) is altered (dropped) to the voltage of the data signal (Vdata) from the first voltage (Vsus), thus the voltage of the second node (V[N2]) in the floating condition is altered (dropped) according to the altering value of the first node voltage (V[N1]). At this time, the voltage of the second node (V[N2]) may be determined by the altering value of the voltage of the first node (V[N1]) and the volume ratio of the first and second capacitor C1, C2.

Also, a fixed current flows to the turned on first transistor T1 by the data signal (Vdata) during the third period t3.

In other words, if the voltage (Vgs) between the gate and the source of the first transistor T1 is to be more than the threshold voltage of the first transistor T1 by applying the data signal (Vdata) to the gate electrode of the first transistor T1 during the third period t3, the fixed current flows to the drain electrode from the source electrode of the first transistor T1.

The above-mentioned current flows to the second power (ELVSS) via the fourth transistor T4 from the drain electrode of the first transistor T1.

The source voltage (Vs) of the first transistor T1 is further altered (dropped) from the voltage being set during the second period t3 while current flows to the first transistor T1, because the source electrode of the first transistor T1 is in the floating condition. However, the third period t3 is preferably set to a short time such that the source voltage (Vs) is not altered very much.

The current that flows to the first transistor T1 during the third period t3 is changed by the mobility of the first transistor T1 as well as the voltage between the gate and the source (Vgs) corresponding to the data signal (Vdata). Although the data signal (Vdata) remains the same, the source voltage (Vs) is further altered (dropped) when the mobility of the first transistor T1 is high.

Accordingly, the voltage that makes it possible to compensate for the mobility deviation of the first transistor T1 located in each pixel together with the data signal (Vdata) in the first and second capacitors C1, C2 during the third period t3 is stored.

In other words, the third period t3 is set to the data programming period and the period for compensating the mobility.

In contrast, the voltage that makes it possible to compensate for the threshold voltage and the mobility deviation of the first transistor T1 together with the data signal (Vdata) is stored in the first and second capacitors C1, C2 during the third period t3. This is due to the threshold voltage of the first transistor T1 being stored in the first capacitor C1 during the second period t2.

If the voltage that makes it possible to compensate for the threshold voltage and the mobility deviation of the first transistor T1 together with the data signal (Vdata) is stored in the first and second capacitors C1, C2, the supply of the scanning signal is stopped and the second and fourth transistors T2, T4 are turned off.

If the second transistor T2 is turned off, the first node N1 is set to the floating condition. Thus, the voltage that makes it possible to compensate for the data signal (Vdata) charged during the third period t3 and the threshold voltage and mobility deviation of the first transistor T1 is stably kept, regardless of the voltage (Voled) applied to the organic light emitting diode (OLED) by the driving current from the first transistor T1 during the following light emitting period t4.

After the scanning period t1~t3 is completed, during the fourth period t4 set as the light emitting period, the light emitting control signal of low voltage is supplied to the light emitting control line En.

Accordingly, the third transistor T3 is turned on, so that the voltage of the first power supply (ELVDD) is delivered to the second node N2.

Then, the driving current flows from the first power supply (ELVDD) to the second power supply (ELVSS) via the third transistor T3, the first transistor T1 and the organic light emitting diode (OLED).

At this time, the driving current is controlled by the first transistor T1 corresponding to the voltage of the first node N1, the voltage corresponding to the threshold voltage and the mobility of the first transistor T1 is stored together with the voltage of the data signal in the first node N1 during the third period t3, so that the driving current corresponding to the data signal flows by compensating the threshold voltage and the mobility deviation of the first transistor T1 during the fourth period t4.

Accordingly, the organic light emitting display device employing the pixel 140 may display a uniform image regardless of the threshold voltage and the mobility deviation of the first transistor T1 between the pixels.

Also, the first node N1 is kept under the floating condition during the fourth period t4, so that the voltage between gate-source of the first transistor T1 is kept constant. Thus, although a few voltage drops (IR Drop) occur while delivering the first power (ELVDD) to the pixels, the voltage gap between the source voltage Vs and the gate voltage Vg of the first transistor T1 is kept constant so that an image having constant luminance may be displayed regardless of the voltage drop of the first power supply (ELVDD) due to the location of the pixels.

That is, the fourth period t4 is the light emitting period of the pixel. During the fourth period t4, the organic light emitting diode (OLED) emits light as the luminance corresponding to the data signal regardless of the voltage drop of the first power supply (ELVDD) and the threshold voltage and the mobility deviation of the first transistor T1.

In contrast, the voltage of the second node (V[N2]) is increased during the fourth period t4, and the voltage of the first node (V[N1]) is increased according to the voltage change of the second node N2.

Figure 4:
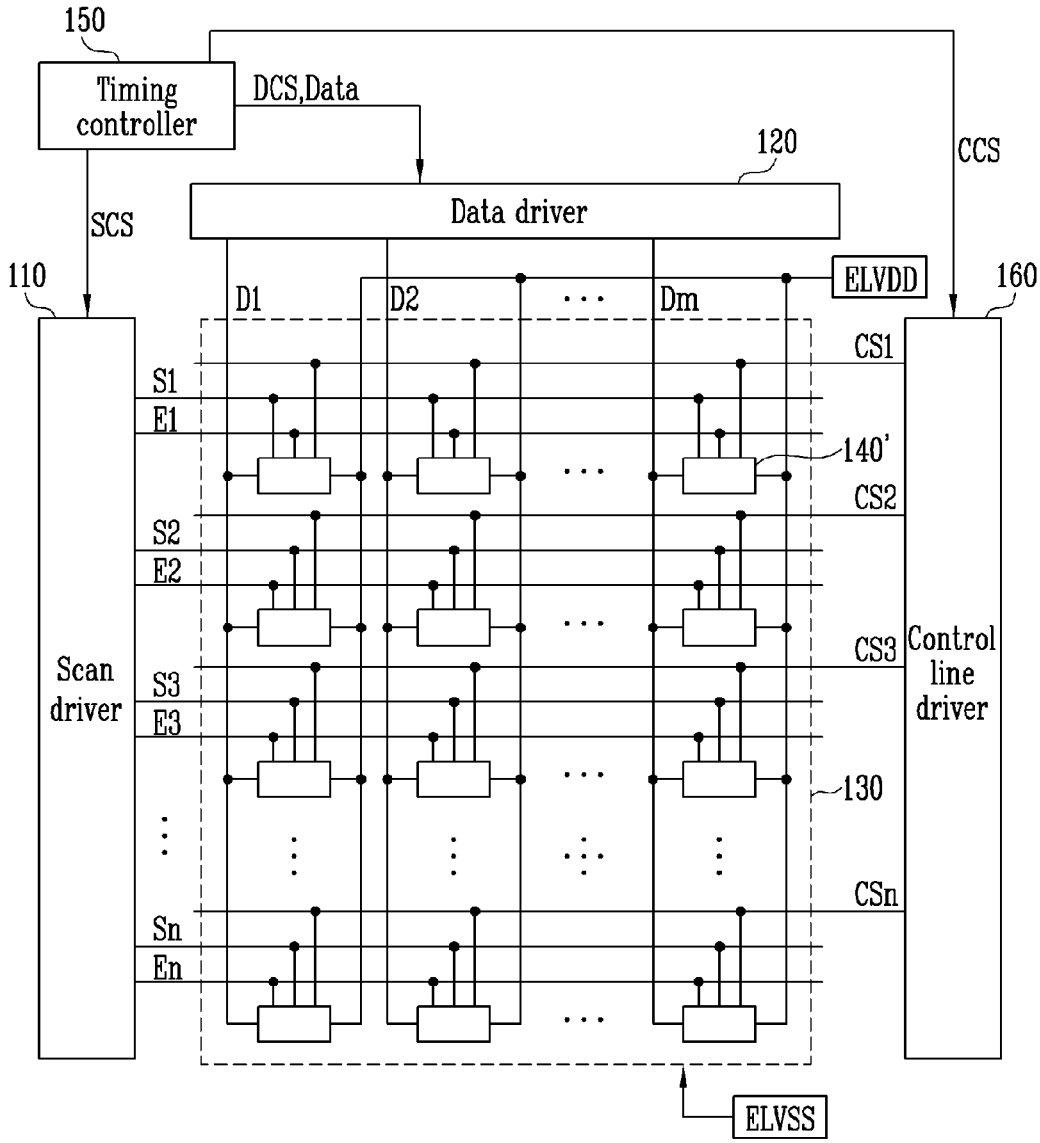
FIG. 4 is a block view roughly showing a structure of an organic light emitting display device according to another embodiment of the present invention.

FIG. 4 is a block view roughly showing a structure of an organic light emitting display device according to another embodiment of the present invention. For convenience of explanation, when describing FIG. 4, the description of the same parts or similar parts as FIG. 1 will not be provided.

Referring to FIG. 4, the organic light emitting display device according to another embodiment of the present invention further includes the control lines CS1 to CSn aligned with the scanning lines S1 to Sn, and the control line driver 160 for driving the control lines CS1 to CSn.

The control line driver 160 generates the control signal by being supplied with the control line driving control signal (CCS) from the timing controller 150, and sequentially supplies the generated control signal to the control lines CS1 to CSn.

In other words, each pixel 140' is driven by being further supplied with the control signal from the control lines CS1 to CSn in the organic light emitting display device according to the other embodiment of the present invention. For example, each control line CS1 to CSn is connected to the gate electrode of the fourth transistor in the pixels 140', so that the control line can control on/off of the fourth transistor. In addition, the light emitting control line En is connected to the gate electrodes of the third and fifth transistors, and emits a light emitting control signal to control the on/off of the third and fifth transistors.

However, the control line driver 160 is supplied with the control signal that can turn on the fixed transistor (fourth transistors) in the pixel 140' through the control line C. during the first and second period. At this time, the first voltage (Vsus) is supplied to the data lines D1 to Dm among the scanning period that is supplied with the scanning signal to the scanning line S connected to the pixels 140' based on the pixels 140' supplied with the scanning signal.

In addition, the control line driver 160 supplies the control signal that can turn on the fixed transistor (fourth transistor) in the pixel 140' to the control line C during the third period at which time the data signal (Vdata) is supplied to the data lines D1 to Dm among the scanning period.

Meanwhile, in FIG. 4 the control line driver 160 is shown as a component separate from the scanning driver 110, but aspects of the present invention are not limited thereto, and the scan driver 110 and the control line driver 160 can be formed as a single unit. For example, it can be possible that the circuit for producing the control signal can be included in the scanning driver 110.

The above-mentioned examples of the pixels 140' applicable to the organic light emitting display device according to the embodiment of the present invention will be described with reference to FIG. 5 to FIG. 6.

Figure 5:
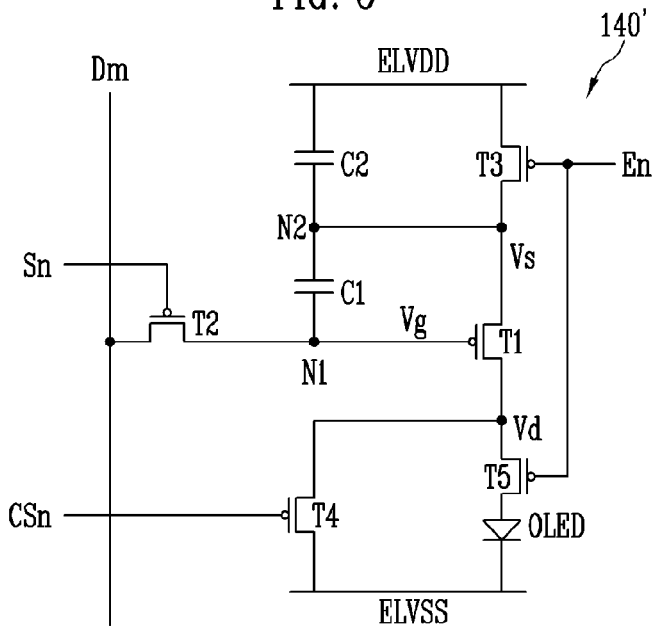
FIG. 5 is a circuit view showing pixels of an organic light emitting display device according to another embodiment of the present invention.

FIG. 5 is a circuit view showing pixels of an organic light emitting display device according to another embodiment of the present invention. FIG. 6 is a waveform showing the method for driving the pixels illustrated in FIG. 5. For convenience of explanation, when describing FIG. 5 and FIG. 6, a description of the same or similar parts as those already described in FIG. 2 and FIG. 3 will be omitted.

Referring to FIG. 5, the pixels 140' differ from the pixels 140 illustrated in FIG. 2, in that a fifth transistor T5 is connected between the access node (i.e., the drain electrode of the first transistor T1) and the organic light emitting diode (OLED) and the gate electrode of the fifth transistor T5 is connected to the light emitting control line En. In addition, the gate electrode of the fourth transistor T4 is connected to the control line CSn.

Figure 6:
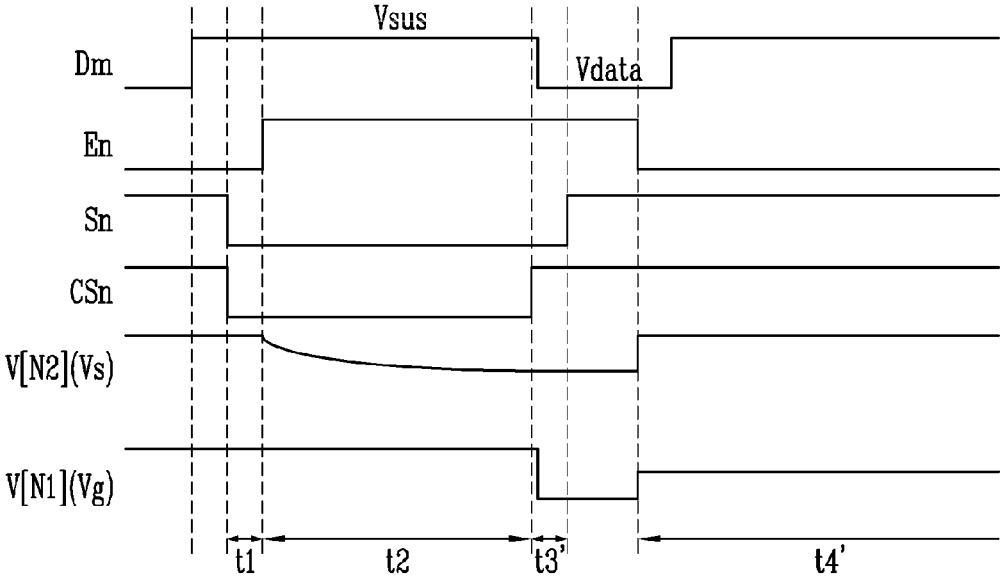
FIG. 6 is a waveform view showing a method of driving pixels as depicted in FIG. 5.

At this time, the control signal supplied from the control line CSn is set to the voltage at which the fourth transistor T4 may turn on during the first and second period t1, t2 of the scanning period as shown FIG. 6, and is set to the voltage at which the fourth transistor T4 may turn off during the third period t3 of the scanning period.

In other words, the fourth transistor T4 is turned off during the third period, unlike the pixel 140 shown FIG. 2.

Also, during the above-mentioned third period t3', the additional fifth transistor T5 is kept at a turn-off condition by the light emitting control signal of high voltage.

Accordingly, the source electrode and drain electrode of the first transistor T1 are set to the floating condition during the third period t3' so that the current does not flow in the first transistor T1. Thus, the source voltage (Vs) is kept constant without any drop during the third period t3'.

Accordingly, the voltage rise of the second node (V[N2]) is decreased compared to the pixel of FIG. 2 when starting the fourth period t4', thus the voltage rise of the first node is decreased.

That is, provided that the same intensity is displayed, in the case of the pixel 140', it is possible to set the high voltage of the data signal (Vdata) compared to the pixel 140 of FIG. 2.

Thus, there is an advantage that the width of swing between the first voltage (Vsus) and the data signal (Vdata) may be decreased.

Figure 7:
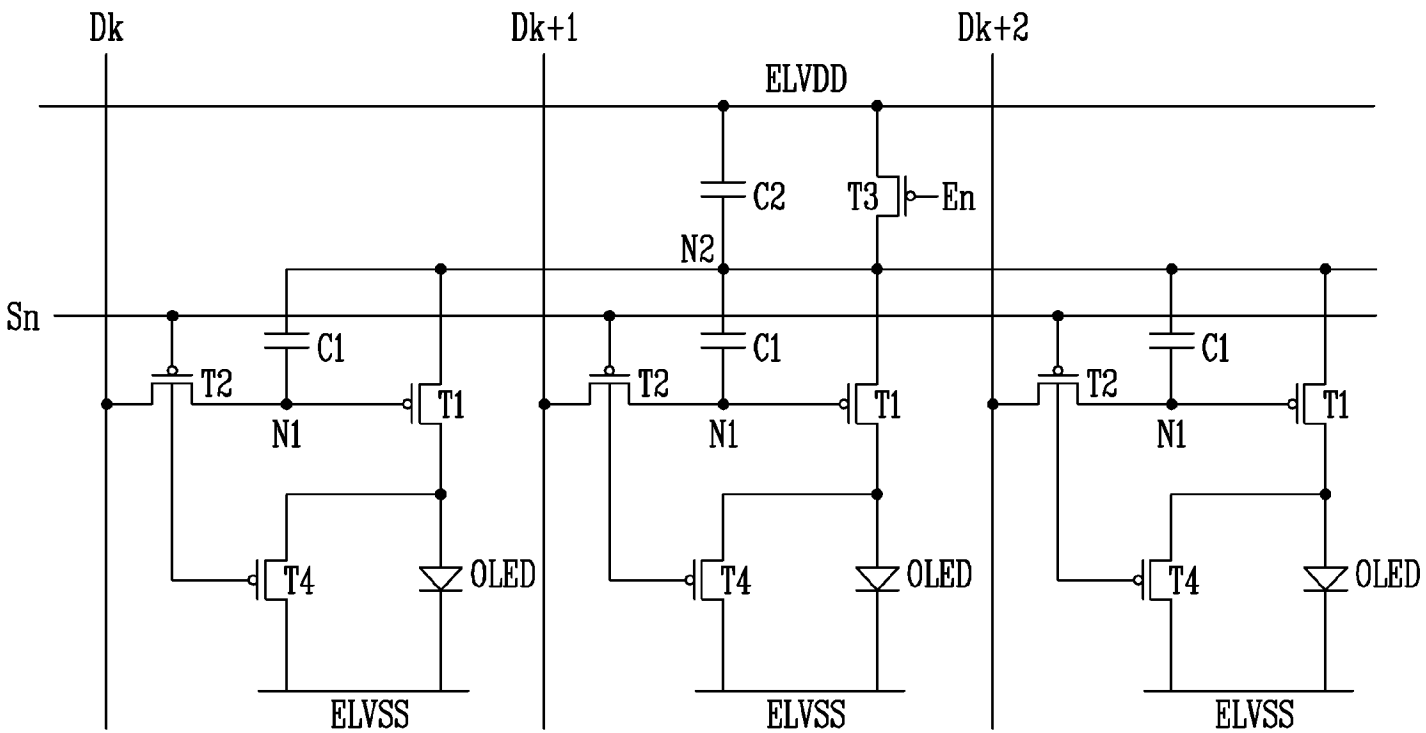
FIG. 7 is a circuit view showing an embodiment that a plurality of pixels share the transistor.

FIG. 7 is a circuit view showing a plurality of the pixel sharing a fixed transistor with the capacitor. FIG. 7, and shows adjacent pixels connected to the k-th (here, k is a natural number), k+1-th and k+2-th data line (Dk, Dk+1, Dk+2) share the fixed transistor with the capacitor. For convenience of explanation, when describing FIG. 7, the descriptions of the same or similar parts as those described in FIG. 2 will be omitted.

Referring to FIG. 7, the structure of the pixel is simplified and the space occupied by the components is minimized by sharing the fixed transistor and/or the capacitor with other pixels.

Particularly, pixels driven at the same time by supplying the same scanning signal and the light emitting control signal, that is a plurality of pixels among the pixels that are located in the same row, may be designed to share the fixed transistor and/or the capacitor.

For instance, the red pixel, the green pixel and the blue pixel constituting one unit pixel may be designed to share with the second capacitor C2, or may be designed to share with the second capacitor C2 and the third transistor T3.

Also, a plurality of pixels located in the same line row may be designed to share the second capacitor C2 and the third transistor T3.

It is also noted that the aspects of the present invention are not limited to the arrangements of the pixels and capacitors noted above and other arrangements of the pixels and capacitors are possible.

Since a plurality of pixels are located in the same row and are capable of being driven at the same time with the second capacitor C2 and/or the third transistor T3, the area occupied by the pixels may be minimized and the design of each pixel may be simplified.

Accordingly, it is possible to increase the size of the second capacitor C2 while minimizing the size of the circuit.

As noted above, if the size of the second capacitor C2 is increased, the size ratio of the first and second capacitor C1, C2 is changed, so as to decrease a width between alternating cycles (swing) of the voltage of the first node (V[N1]).

In other words, the swing between the first voltage (Vsus) and the voltage of the data signal (Vdata) may be decreased because of the expansion in size of the second capacitor C2.

On the other hand, while FIG. 7 shows a plurality of the pixels sharing the second capacitor C2 and the third transistor T3, the aspects of the present invention are not limited thereto.

For instance, only the second capacitor C2 may be commonly shared with the pixels.

Figure 8:
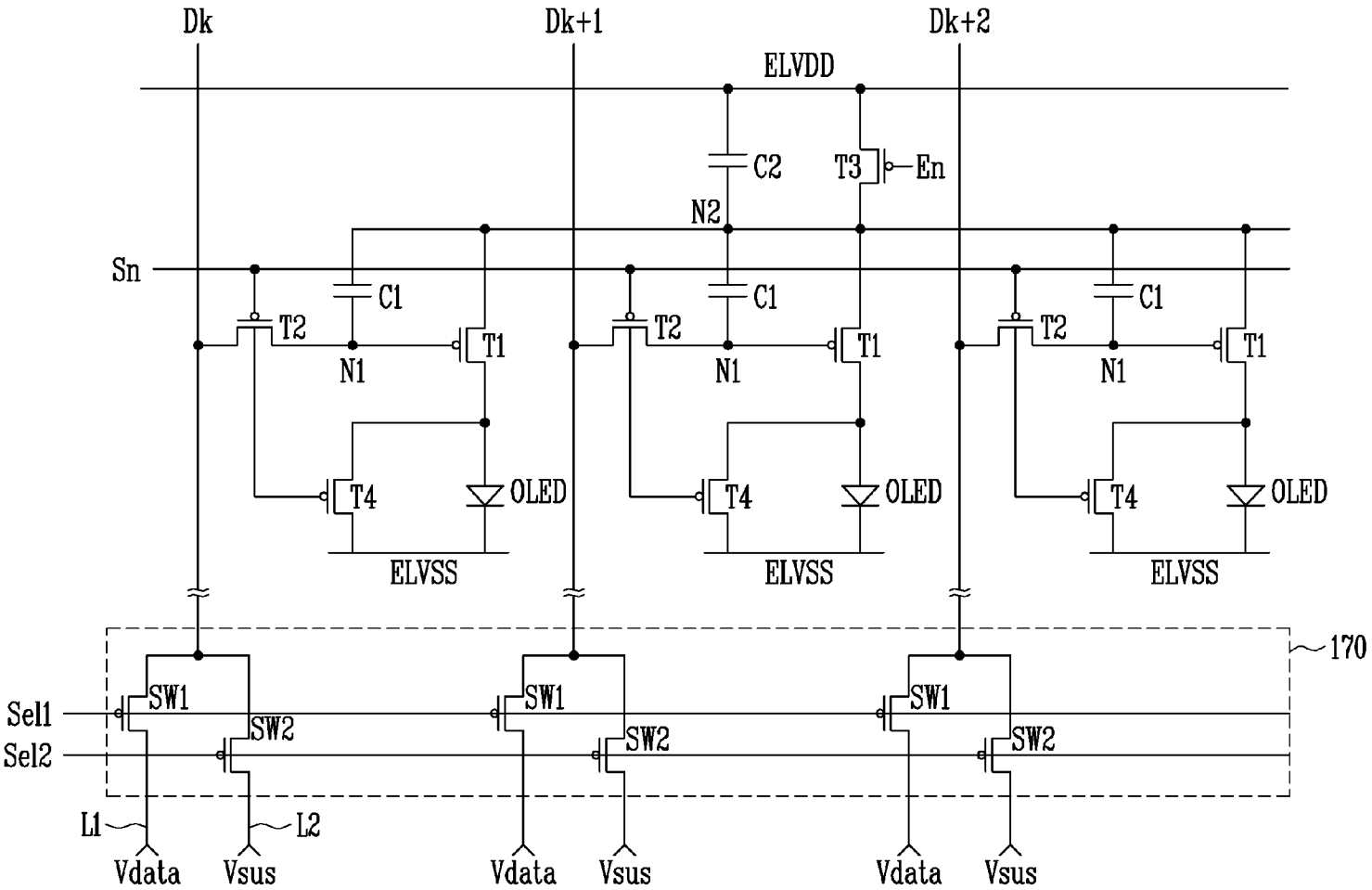
FIG. 8 is a circuit view showing an embodiment that the switch unit selectively supplies the data signal and the first voltage to the data lines by connecting to the input unit of the data lines.

FIG. 8 is a circuit view showing another embodiment of the present invention including the switch part selectively supplying the data signal and the first voltage to the data lines by connecting to the input part of the data lines. For convenience of explanation, FIG. 8 illustrates the embodiment of FIG. 7, thus, the description of the same or similar parts to FIG. 7 will not be provided.

Referring to FIG. 8, the switch part for alternately supplying the data signal (Vdata) and the first voltage (Vsus) to the data lines D is connected to the input part of the data lines D. The above-mentioned switch part 170 may be located between the pixels and the data driver, for instance and may be connected between the pixel part 130 and the data driver 120 of FIG. 1.

The switch part 170 includes the first switches SW1 connected to each channel of the data driver 120. That is, the switch part 170 includes the first switches SW1 connected between each first input line L1, to which the data signal (Vdata) is input from the data driver 120, and each of the data lines D1 to Dm.

Also, the switch part 170 includes the second switches SW2, each connected between the second input line L2, to which the first voltage (Vsus) is input, and a corresponding data line D1 to Dm. FIG. 8 shows an embodiment wherein each second input line L2 is connected to every data line D1 to Dm, and to the voltage source supplying the first voltage (Vsus).

The above-mentioned first switches SW1 and the second switches SW2 supply the data signals (Vdata) and the first voltage (Vsus) to the data lines D1 to Dm while alternately being turned on. The switch part 170 may supply the first and second select signal Sel1, Sel2 from the timing control part 150 of FIG. 1.

By incorporating the switch part 170, the data driver 120 may output only the data signal (Vdata) without alternately outputting the first voltage (Vsus) and the data signal (Vdata). Thus the data driver 120 is easy to design, and the pixel according to an aspect of the present invention may be driven using the existing commercialized data driver 120.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode connected between a first power supply and a second power supply;

a first transistor connected between the first power supply and the organic light emitting diode, wherein a gate electrode of the first transistor is connected to a first node;

a second transistor connected between the first node and a data line, wherein the gate electrode of the second transistor is connected to a scanning line;

a third transistor connected between the first power supply and a first electrode of the first transistor, wherein a gate electrode of the third transistor is connected to a light emitting control line;

a fourth transistor connected between an access node of the first transistor, and the second power supply, which is turned on during a scanning period in which the second transistor is turned on; and first and second capacitors connected between the first power supply and the first node, wherein an access node of the first and second capacitors is connected to the access node of the first and third transistors, wherein a gate electrode of the fourth transistor is connected to the scanning line.

2. The pixel as claimed in claim 1, wherein a scan driver is connected to the scanning line to supply a scan signal, such that the third transistor and the fourth transistor are turned on together with the second transistor during a first period, the first period being an initial period of the scanning period, and wherein a first voltage is supplied to the data line during the first period.

3. The pixel as claimed in claim 2, wherein a light emitting control driver is configured to:

turn off the third transistor from a second period which follows the first period of the scanning period;

keep the third transistor in a turned-off condition during a remainder of the scanning period; and turn on the third transistor after the scanning period is completed.

4. The pixel as claimed in claim 2, wherein a data driver is configured to:

supply the first voltage to the data line during the first period and a second period followed by the first period; and supply a data signal to the pixel through the data line during a third period followed by the first and second periods of the scanning period.

5. The pixel as claimed in claim 2, wherein the first voltage is set to a voltage lower than the voltage of the first power supply by more than a threshold voltage of the first transistor.

6. The pixel as claimed in claim 1, wherein the first power supply is set to a high potential pixel power supply, and the second power supply is set to a low potential pixel power supply.

7. An organic light emitting display device comprising:

a scanning driver that sequentially supplies a scanning signal to scanning lines, and supplies a light emitting control signal to light emitting control lines that are aligned with the scanning lines;

a data driver that supplies a data signal to data lines; and a pixel unit that is arranged at an intersection of the scanning lines, the light emitting control lines and the data lines, and includes a plurality of pixels supplied with a first power supply and a second power supply;

wherein each pixel comprises:

an organic light emitting diode connected between the first power supply and the second power supply;

a first transistor connected between the first power supply and the organic light emitting diode, wherein a gate electrode of the first transistor is connected to a first node;

a second transistor connected between the first node and one of the data lines, wherein the gate electrode of the second transistor is connected to one of the scanning lines;

a third transistor connected between the first power supply and the first transistor, wherein the gate electrode of the third transistor is connected to one of the light emitting control lines;

a fourth transistor connected between an access node of the first transistor and the organic light emitting diode and the second power supply, and the fourth transistor is turned on during a scanning period in which the second transistor is turned on; and first and second capacitors disposed between the first power supply and the first node;

wherein an access node of the first and second capacitors is connected to an access node of the first and third transistors, and wherein the gate electrode of the fourth transistor is connected to the scanning line.

8. The organic light emitting display device as claimed in claim 7, wherein the scanning driver is configured to turn on the third transistor during a first period, which is an initial period of the scanning period of each pixel, by supplying the light emitting control signal to the light emitting control line, and wherein the scanning driver is configured to turn off the third transistor during a rest of the scanning period by supplying the light emitting control signal to the light emitting control line.

9. The organic light emitting display device as claimed in claim 8, wherein the data driver is configured to supply a first voltage to the data line during the first period and a second period following the first period of the scanning period, and wherein the data driver is configured to supply the data signal to the data line during a third period following the first and second periods of the scanning period.

10. The organic light emitting display device as claimed in claim 9, wherein the first voltage is set to a voltage lower than the voltage of the first power supply by more than a threshold voltage of the first transistor.

11. The organic light emitting display device as claimed in claim 7, wherein a plurality of pixels disposed in a same row of the pixels share the second capacitor.

12. The organic light emitting display device as claimed in claim 11, wherein a plurality of pixels disposed in a same row of the pixels share the third transistor.

13. The organic light emitting display device as claimed in claim 7, further comprising a switching unit including first switches connected between a first input line that the data signal is inputted from the data driver, and the data lines; and second switches connected between a second input line that a constant first voltage is inputted, and the data lines, wherein the switching unit is alternately turned on with the first switches.

* * * * *

UNITED STATES PATENT AND TRADEMARK OFFICE

CERTIFICATE OF CORRECTION

PATENT NO. : 8,497,824 B2
APPLICATION NO. : 12/980043
DATED : July 30, 2013
INVENTOR(S) : Jin-Tae Jeong It is certified that error appears in the above-identified patent and that said Letters Patent is hereby corrected as shown below:

In the Claims

| | |
|---|---|
| Column 13, Claim 4, line 54 | Delete "of"<br>Insert -- among -- |

Signed and Sealed this
Ninth Day of December, 2014

Michelle K. Lee

Michelle K. Lee
*Deputy Director of the United States Patent and Trademark Office*